US009119232B2

(12) United States Patent
Clauss et al.

(10) Patent No.: US 9,119,232 B2
(45) Date of Patent: Aug. 25, 2015

(54) ELECTRICAL HEATING DEVICE

(75) Inventors: Maurice Clauss, Nordhouse (FR); Franz Bohlender, Kandel (DE); Michael Niederer, Kapellen Drusweiler (DE)

(73) Assignee: Eberspacher catem GmbH & Co. KG, Herxheim (DE)

( * ) Notice: Subject to any disclaimer, the term of this patent is extended or adjusted under 35 U.S.C. 154(b) by 974 days.

(21) Appl. No.: 13/252,503

(22) Filed: Oct. 4, 2011

(65) Prior Publication Data

US 2012/0085743 A1 Apr. 12, 2012

(30) Foreign Application Priority Data

Oct. 8, 2010 (EP) ..... 10013475

(51) Int. Cl.

| | |
|---|---|
| ***B60L 1/02*** | (2006.01) |
| ***F24H 1/10*** | (2006.01) |
| ***F24H 1/08*** | (2006.01) |
| ***H05B 3/24*** | (2006.01) |

(52) U.S. Cl.

CPC ..... *H05B 3/24* (2013.01); *H05B 2203/02* (2013.01)

(58) Field of Classification Search

CPC ..... H05B 2203/02

USPC ..... 219/202, 205–208; 361/728, 807; 392/465–466, 471, 479–481, 485–486

See application file for complete search history.

(56) References Cited

U.S. PATENT DOCUMENTS

| | | | | |
|---|---|---|---|---|
| 3,239,649 | A * | 3/1966 | Reeve | 392/447 |
| 4,531,456 | A * | 7/1985 | Kemp et al. | 99/323.2 |
| 6,053,092 | A * | 4/2000 | Anderson | 99/275 |
| 8,421,396 | B2 | 4/2013 | Yamada et al. | |
| 2008/0000889 | A1 | 1/2008 | Niederer et al. | |
| 2008/0044168 | A1 * | 2/2008 | Eichholz et al. | 392/471 |
| 2008/0099464 | A1 | 5/2008 | Niederer et al. | |
| 2009/0192671 | A1 | 7/2009 | Bolender et al. | |
| 2011/0168374 | A1 * | 7/2011 | Watanabe et al. | 165/185 |

FOREIGN PATENT DOCUMENTS

| | | |
|---|---|---|
| EP | 1 872 986 A1 | 1/2008 |
| EP | 1 921 896 A1 | 5/2008 |
| EP | 2 082 920 A1 | 7/2009 |

(Continued)

OTHER PUBLICATIONS

Chinese Search Report Dated Oct. 8, 2011 for Chinese Patent Application Serial No. 201110300907.6.

(Continued)

*Primary Examiner* — Tu B Hoang
*Assistant Examiner* — Michael Hoang
(74) *Attorney, Agent, or Firm* — Boyle Fredrickson, S.C.

(57) ABSTRACT

An electrical heating device comprises a housing which encloses a circulation chamber through which a medium can flow, and into which heating ribs protrude. Each of the heating ribs has a U-shaped recess which open into a uniform connecting chamber, which is separated from the circulation chamber by a partition wall provided in the region of the open ends of the U-shaped recesses, and which accommodates at least one PTC heating element that abuts oppositely situated inner sides of the U-shaped recess in heat-conducting contact. A housing cover bears a pump and forms a pump channel. The pump channel opens into an inlet opening of the pump, which is formed by a pump housing.

15 Claims, 15 Drawing Sheets

(56) References Cited

FOREIGN PATENT DOCUMENTS

| | | | | |
|---|---|---|---|---|
| WO | WO 2009093618 A1 * | 7/2009 | ..... | H05K 7/20 |
| WO | 2010/088405 A1 | 8/2010 | | |

OTHER PUBLICATIONS

European Search Report Dated Mar. 10, 2011 for European Patent Application Serial No. EP 10 01 3475.

* cited by examiner

ELECTRICAL HEATING DEVICE

BACKGROUND OF THE INVENTION

1. Field of the Invention

The present invention relates to an electrical heating device with a housing, which encloses a circulation chamber through which a medium can flow, into which heating ribs extend, which each have a U-shaped recess, which open into a uniform connecting chamber, which is separated from the circulation chamber by a partition wall provided in the region of the open ends of the U-shaped recesses, and accommodates at least one PTC heating element, which abuts oppositely situated inner sides of the U-shaped recess in heat-conducting contact.

2. Description of the Related Art

An electrical heating device of this nature is known from EP 1 872 986 A1 which originates from the applicant.

SUMMARY OF THE INVENTION

The object of the present invention is to further develop the generic electrical heating device. The intention of the present invention is to specify in particular a compactly constructed electrical heating device which is relatively simple in construction and can also be operated at high working pressures of the fluid to be heated.

In this respect the present invention suggests an electrical heating device having a housing which encloses a circulation chamber through which a medium can flow. Ribs protrude into the circulation chamber, each of the ribs having a U-shaped recess which open into a uniform connecting chamber which is separated from the circulation chamber by a partition wall provided in the region of open ends of the U-shaped recesses. At least one PTC heating element is accommodated in the housing and abuts oppositely situated inner sides of the U-shaped recess in heat-conducting contact. A housing cover is provided which bears a pump and forms a pump channel which opens into an inlet opening of the pump which is formed by a pump housing. The heating device according to the invention accordingly facilitates connection of the pump to the housing without using hoses. The medium to be heated can enter the pump directly from the circulation chamber without hose sections, which are susceptible to failure, having to be fitted in an elaborate way between the heating device and the pump.

With the electrical heating device according to the invention the housing which encloses the circulation chamber is closed with a housing cover which is provided in the constructional unit with the pump. In this way a compactly constructed electrical heating device is formed. It is also possible to provide the pump channel situated opposite the circulation chamber and separated by a respectively thin cover or membrane. The hydrostatic pressure on both sides of this membrane basically compensates itself and the construction is overall simplified and nevertheless particularly suitable for operation with high fluid pressures. A thin membrane between the pump channel and the circulation chamber can furthermore be made less thick, further favouring a compact construction.

The housing cover formed according to the invention preferably forms in any case parts of the pump housing in one block. The housing cover can here be formed as an aluminium die-cast part. Furthermore, the pump housing and the housing preferably each have a connection piece, whereby the connection piece on the pump housing communicates directly with a pump chamber of the pump, which pumps the fluid to be heated into the pump channel or out of it. For the purpose of the invention a connection piece is used especially to connect a hose to convey the fluid to be heated outside of the housing or the housing cover and to other system components, for example heat exchangers within a motor vehicle.

The housing of the electrical heating device is preferably an elongated housing, whereby the connection to the pump and/or the circulation chamber preferably occurs on the face side, preferably in each case through connection pieces which are provided on the face side. On the face side situated opposite the connection piece there is normally a control housing, which accommodates the controller preferably for the PTC heating element(s) and also the pump.

According to a preferred further development of the present invention the previously mentioned membrane is formed by a covering element. For the purpose of the invention a covering element is clamped sealing between the housing and the housing cover and accordingly separates a flow channel, which is formed in the circulation chamber and which is enclosed between the partition wall and the covering element, from the pump channel. The covering element also has a flow passage aperture through which the flow channel communicates with the pump channel. This flow passage aperture is preferably provided on a face-side end of the housing and formed as a type of penetration in the covering element.

The covering element can be held within the housing just by the clamping force between the housing cover and the housing in the marginal region of the two parts of the housing. Also a relatively thin covering element is held in position between the housing and the housing cover due to the essentially equal hydrostatic pressure relationships on both sides of the covering element.

However, it is preferable to form tapered ridges on the underside of the heating ribs, the face sides of which are arranged a support level for the covering element. For this purpose the housing cover has corresponding supporting counter ridges. Here, the covering element is clamped for sealing between the supporting ridges and the supporting counter ridges. In the region of the ridges or counter ridges this embodiment offers a relatively high surface pressure, resulting in sealing of the cover plate such that the fluid to be heated can be subjected to a relatively high pressure of more than 35 bar. Here it is preferable if the pump channel is formed with about the width of the heating ribs, i.e. with the whole extent of the supporting ridges in their longitudinal direction opposite the supporting counter ridges, so pressurised fluid is present on both sides of the flat covering element. In this way the pressure difference on the area to be sealed within the housing is minimised.

The supporting ridges are tapered, i.e. they have a thickness which is less than the thickness of the heating ribs. Thickness in this sense is normally taken to mean an extension which runs at right angles to the insertion direction of the FTC heating elements into the U-shaped recesses and at right angles to the longitudinal extension of the FTC heating elements. The heating ribs normally extend transversely to the longitudinal extension of a longitudinal housing. Due to these supporting ridges the covering element is positioned in a supporting level against the housing. There is good sealing of the individual flow sections of the meander-like flow channel, which preferably extend parallel to one another, and of the pump channel, which normally extends at right angles to the main sections of the flow channel. Accordingly, the medium to be heated flows completely through the flow passage. A short-circuit flow, which passes the bottom end of the U-shaped recess, is prevented. The tapered ridges are thinner than the heating ribs, so that heat transfer to the medium in the region of the bottom of the U-shaped recess can also occur, which further improves the thermal efficiency.

According to a preferred further development of the present invention the heating ribs protrude alternately from oppositely situated inner sides of the housing towards the inside, and namely such that the flow channel is formed meandering in the housing and comprises flow passages between the free ends of the heating ribs and the adjacent inner wall of the housing. With this preferred further development, which facilitates a high thermal efficiency of the electrical heating device, the flow diversion occurs in each case between the free ends of the heating ribs and the adjacent side wall. Here, for good heat transfer the flow in the flow channel flows against the connection of the heating rib to the housing following in the flow direction. This produces good heat transfer also on a base of the heating rib joined to the housing. Also the free end of the heating rib is subject to the flow. In other words a very good heat transfer to the medium to be heated in the heating device is produced, not only on oppositely situated longitudinal sides of the PTC heating element, but rather also on its face sides. A PTC heating element here normally consists of one or a plurality of PTC ceramic blocks, coated on both sides with a metallisation coating, on the oppositely situated lateral faces of which sheet metal bands abut, which are supplied with current of different polarity. One or a plurality of PTC heating element of this nature are in each case accommodated in a U-shaped recess. This U-shaped recess is open on one side, namely to the connecting chamber; towards the underside the U-shaped recess is closed. This closure of the U-shaped recess can be of a material other than that of which the housing is formed. The housing and the heating ribs are normally formed from one block. In this respect a cast block is normally involved. Preferably, the heating walls defining the U-shaped recess ribs and the housing are uniformly manufactured by means of aluminium die-casting. The U-shaped recesses are bounded by the relatively stiff walls of the heating ribs. They are as thin-walled as possible in order to facilitate effective thermal transmission and dissipation into the medium to be heated. However, the oppositely situated side walls of the heating ribs are thick and thus stiff enough to ensure good abutment of the PTC heating elements on the inner sides of the U-shaped recess.

For this purpose the PTC heating element can be fixed in the recess with a good thermally conducting casting compound or similar product. Preferably and in consideration of simple manufacture of the electrical heating device, the PTC heating element is formed according to the disclosure of EP 1 872 986 or, especially preferably according to 1 921 896 A1. Both publications are included through reference in the disclosed content of these application documents. This means that the PTC heating element preferably also comprises a wedge element which is provided for sliding relative to the PTC block and the sheet metal bands that abut it and through which good prestressing and thermal contacting between the PTC heating element and the inner sides of the U-shaped recesses can be achieved. For further details of this wedge element and the interaction with the PTC block reference is made to the disclosure of the two previously mentioned European patent applications.

The meander-type flow guidance in the housing leads to an improved thermal efficiency with respect to the electrical heating device known from EP 1 872 986 A1. With this embodiment the U-shaped recesses extend in the main flow direction within the housing. Due to the permanent deflection of the flow by the meander-type flow guidance, a laminar flow is largely avoided. In particular the heat emitting surfaces of the heating ribs are not subjected to a flow which extends essentially parallel to the surface of the ribs. Instead, due to velocity components of the flow at right angles to the surface of the ribs, good heat transfer and dissipation to the medium to be heated is achieved. Since the PTC heating elements also discharge heat to both oppositely situated face sides, there is good dissipation of the heat produced by the PTC heating elements and thus a higher thermal efficiency.

According to a preferred further development, this can be further improved in that the heating ribs are joined by a ridge to the associated inner wall of the housing. The ridge is less thick than the associated heating rib. Accordingly, the heating rib is also contacted by fluid on its face side at its end at the base. The ridge can be relatively thin so that significant parts of the face side of the heating rib at the base are exposed into the flow.

The surface and in particular the cross-sectional shape of the ridge can be formed for the best possible thermal transfer to the base-end of the heating rib. Particularly good heat transfer with adequate stiffness is offered by an embodiment in which the lateral faces of the ridge exposed to the flow channel are curved concavely, so that a hollow-shaped recess is formed between the side wall and the heating rib. With this embodiment notches, which would lead to weakening of the material, are avoided. It has been established that in the depressions flow conditions favouring the heat transfer to the medium to be heated arise, in particular if the depression transfers without any shoulder into an inner wall forming the inside of the housing, which essentially runs in a straight line between the oppositely situated depressions and centrally forms the outer boundary of the flow passage.

The compact embodiment of the heating device is improved further in this way in that a connecting conductor board extending essentially parallel to the partition wall and accommodated in the connecting chamber is provided. This connecting conductor board has electrical connecting elements, which make contact with contact lugs of the PTC heating elements protruding over the partition wall and are electrically connected to conductive paths which are formed by the said connecting conductor board. The connecting conductor board is normally not fitted with electronic components. It is used rather only to connect the PTC heating elements electrically and namely via their connecting lugs. Here, the conductive paths of the connecting conductor board can be formed such that a plurality of PTC heating elements are connected together in a group. The PTC heating elements of the electrical heating device are here preferably grouped in a plurality of heating stages. The grouping of the individual PTC heating elements in a heating stage normally occurs exclusively using the strip conductors of the connecting conductor board. This can furthermore be electrically connected to a thermal probe which is normally provided in the region of a face-side end and protrudes into the circulation chamber. Its temperature signal is normally passed via conductive paths of the connecting conductor board and namely preferably to the face side of the housing oppositely situated to the thermal probe. According to a preferred further development of the present invention, a conductor board fitted with components is located here in which the open-loop and closed-loop control signals are produced for switching the PTC heating elements. The assembled conductor board is located in front of the face side of the housing and is normally positioned at a distance to it, so that the electronic components provided on the assembled conductor board are spaced from the housing.

The connecting conductor board normally has conductive paths on oppositely situated face sides, which are in electrical contact with the connecting conductor board. For this purpose the housing has, according to a preferred further development, on its face side a housing connection opening which opens to the connecting chamber. In this housing connection opening a plug housing is inserted, the electrical plug elements of which are connected to plug counter elements which are provided on the connecting conductor board or on the assembled conductor board. Accordingly the two conductor boards, which extend essentially at right angles to one another, are provided spaced apart. The connecting conductor board is with respect to its extension restricted to the connecting chamber. The assembled conductor board is located exclusively on the face side in front of the housing.

Contacting preferably occurs via electrical plug elements of a plug housing, which is inserted into the metallic housing and is normally formed from plastic. The plug housing is preferably inserted into a housing connection opening which is preferably formed on a face side of the housing and opens towards the connecting chamber. The electrical plug elements can be electrically connected on one or both sides to plug counter elements by means of plug contact. Normally, at least the assembled conductor board has holes into which the electrical plug elements are inserted and can be electrically connected to conductive paths on the assembled conductor board. For this purpose the housing can form supporting surfaces for the electrical conductor board, against which it abuts. The conductor board can however also be mounted in a control housing. With this embodiment the plug contacting of the assembled conductor board to the electrical plug elements normally occurs when mounting the control housing on the housing(s).

The assembled conductor board can bear electronic components in a manner known per se which produce a power loss and contact them electrically. With regard to the dissipation of this power loss, according to a preferred further development of the present invention a cooling element, thermally coupling the face side to the component producing the power loss, is provided between the face side of the housing and the conductor board. The cooling element is normally placed under the component producing the power loss. The electronic component can be supported directly by the cooling element or via intermediate positioning of an electrical insulating layer on the face side of the housing. The cooling element is preferably realised as one part with the housing, especially preferably by a protrusion beyond the face side of the housing.

In so far as the electrical heating device comprises an assembled conductor board, which is electrically connected to the connecting conductor board and extends essentially at right angles to it, according to a preferred further development of the present invention, it is suggested that this assembled conductor board also bears components of the control device for the pump. Consequently, the control device for the pump and the control device for the electrical heating device are realised essentially on one conductor board, which favours a compact embodiment of the electrical heating device. The assembled conductor board here may not only form the control device for the pump, but rather also suitable control circuits for heating circuits, which are made available by a housing cover formed as a housing. In other words the assembled conductor board can be formed right from the start such that it can either control a pump, provided the housing is closed off with a housing cover forming the pump channel, or however can control other heating circuits of a housing cover, provided it is fitted with PTC heating elements and is formed as a type of housing.

According to a further preferred embodiment the electrical heating device has a control housing which encloses the assembled conductor board and constitutes a control housing connection opening formed corresponding to the housing connection opening. The housing connection opening and the control housing connection opening are here preferably formed such that their edges are flush with one another so that a step-free passage from the control housing to the connecting chamber is possible. In this preferred further development the control housing has a further control housing connection opening. This is formed on the control housing mirrored in relation to a level accommodating the covering element. This embodiment offers the possibility that the control housing can be employed with a housing cover formed as a housing. In this case the electrical plug elements of the plug housing extend respectively in the control housing connection opening or the housing connection opening. If only one housing is connected to the plug housing, the electrical contacting of the pump must occur via the other control housing connection opening.

BRIEF DESCRIPTION OF THE DRAWINGS

Further details and advantages of the present invention are given in the following description of an embodiment in conjunction with the drawing. This shows the following.

DETAILED DESCRIPTION OF THE PREFERRED EMBODIMENT

Figure 1:
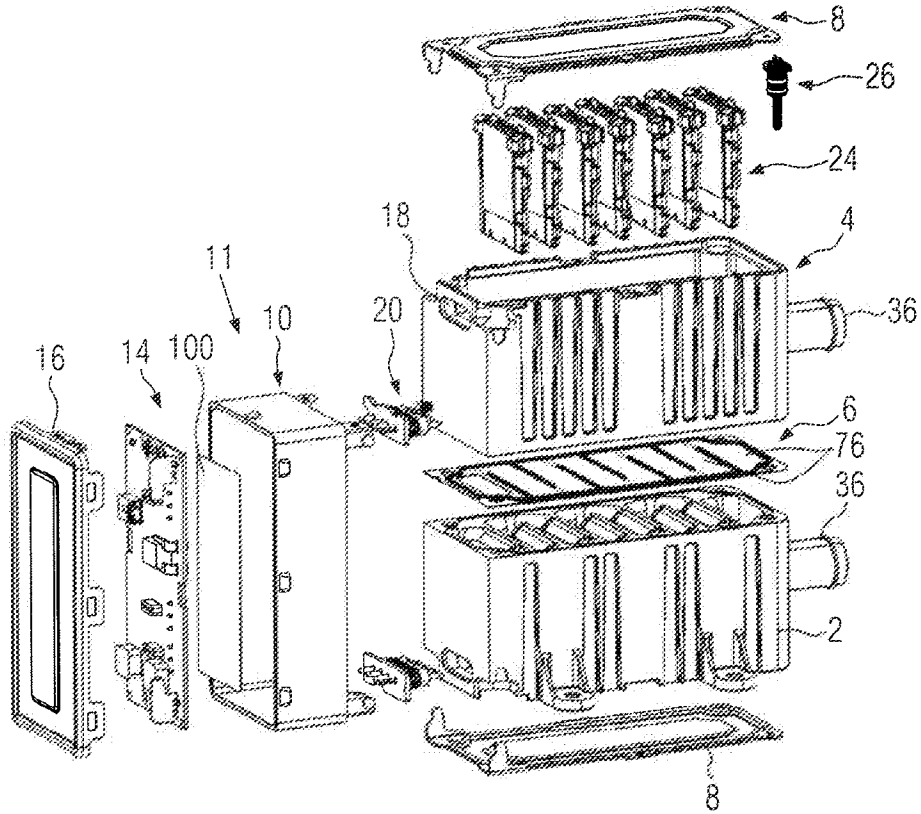
FIG. 1 an exploded drawing of a first embodiment.

FIG. 1 illustrates a perspective exploded drawing of a first embodiment of an electrical heating device. It comprises a first housing 2 and a second housing 4, formed essentially mirrored to it, which with the intermediate positioning of a covering element 6 are joined together, each being covered on the outside by a housing cover 8.

On a common face side of the two housings 2, 4 there is a control housing, identified with the reference numeral 10, of a control device 11, which has a control housing frame 12, which accommodates an assembled conductor board 14 and is closed by a control housing cover 16.

On their face sides facing the control housing 10, both housings 2, 4 have a housing connection opening 18 which is provided close to the housing cover 8. In this control housing connection opening 18 in each case a plug housing 20 can be inserted, which is manufactured from an insulating material, for example plastic, and bears a plurality of plug elements 22, which provide an electrical contact between electrical conductive paths provided in the two housings 2, 4 and the conductive paths of the assembled conductor board 14.

Furthermore, in FIG. 1 heater plate elements 24 are illustrated which are formed slightly wedge-shaped and correspond to those PTC heating elements which are disclosed in the European patent application EP 1 921 896 A1. The disclosure of this European patent publication is included by reference in the disclosed content of this patent application.

A temperature probe 26 is illustrated in front of the row of heater plate elements/PTC heating elements 24.

Figure 2:
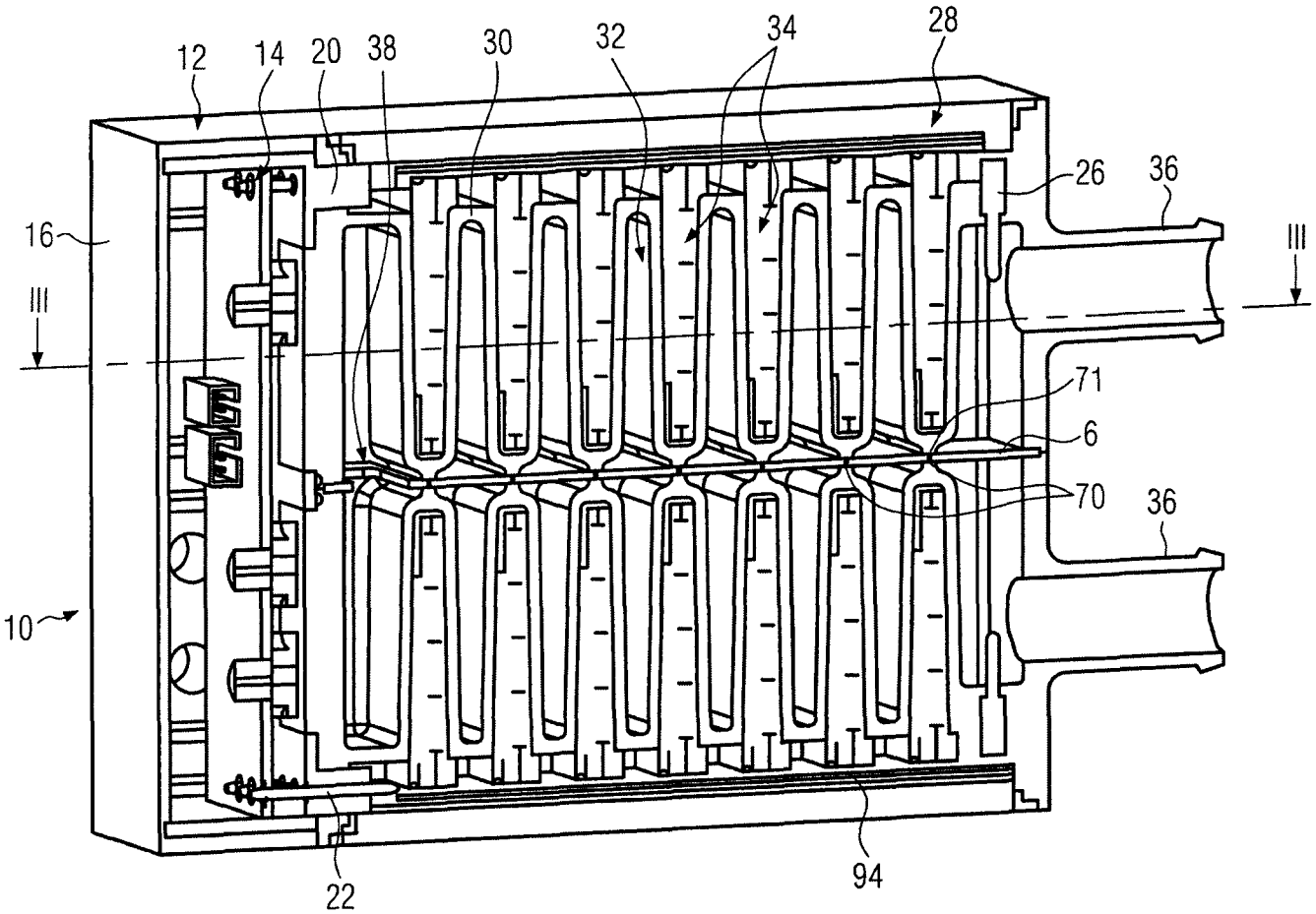
FIG. 2 a central longitudinal section through the embodiment illustrated in FIG. 1.

The installation of these elements into the housings 2, 4 can be particularly taken from FIG. 2. Accordingly, the housings 2, 4 each form two different chambers, namely a connecting chamber 28 and a circulation chamber separated from it by a partition wall 30. From the partition wall 30 in the circulation chamber 32 U-shaped recesses 34 protrude which extend deep into the circulation chamber 32 and terminate at the same height to the connecting chamber 28 as the partition wall 30. These recesses 34 are designed such that the heater plate elements 24 with a wedge surrounded by them can be used for heat conduction against the oppositely situated walls of the U-shaped recesses 34, as comprehensively described by the already mentioned EP 1 821 896 A1.

The circulation chamber 32 of each single housing 2, 4 extends between a connection piece 36 for the connection of a fluid hose and a flow passage aperture 38. Between these two outputs or end points of the circulation chamber 32 within it a meander-type flow channel 40 is formed within the housing 2 or 4, the course of which can be particularly taken from FIG. 3. The flow channel 40 has flow channel sections 42, which extend at right angles to the longitudinal extension of the housing 2 or 4 and are each bounded by outer walls of heating ribs 44 forming the U-shaped recesses 34. These heating ribs 44 are arranged alternately on oppositely situated inner sides 46 of the housings 2, 4. The housing 2 and the heating ribs 44 are here uniformly realised on an aluminium die-cast part. The heating ribs 44 are mounted on the oppositely situated inner sides 46 of the housing 2 or 4 via a ridge 48. This ridge 48 is less thick than the heating ribs 44. Thickness in this sense is taken to be the extent of the ridge in a direction at right angles to the flow channel sections 42, i.e. in the longitudinal direction of the housing 2. The exposed surfaces of the ridges 48, exposed to the flow channel 40, are formed concave, whereby a recess 50 is produced as part of the flow channel 40. In the flow channel 40 the flowing fluid to be heated can accordingly on one hand flow around the free ends 52 of the heating ribs 44, but on the other hand it can also in any case flow around a substantial part of the base end 54, so that the heating ribs 44 can dissipate heat to the fluid to be heated both via their oppositely situated longitudinal sides as well as via their face sides 52, 54. Here, a flow passage 56, which connects the relevant flow channel sections 42 together, is formed between the free ends 52 and the inner side 46 of the housing.

Figure 3:
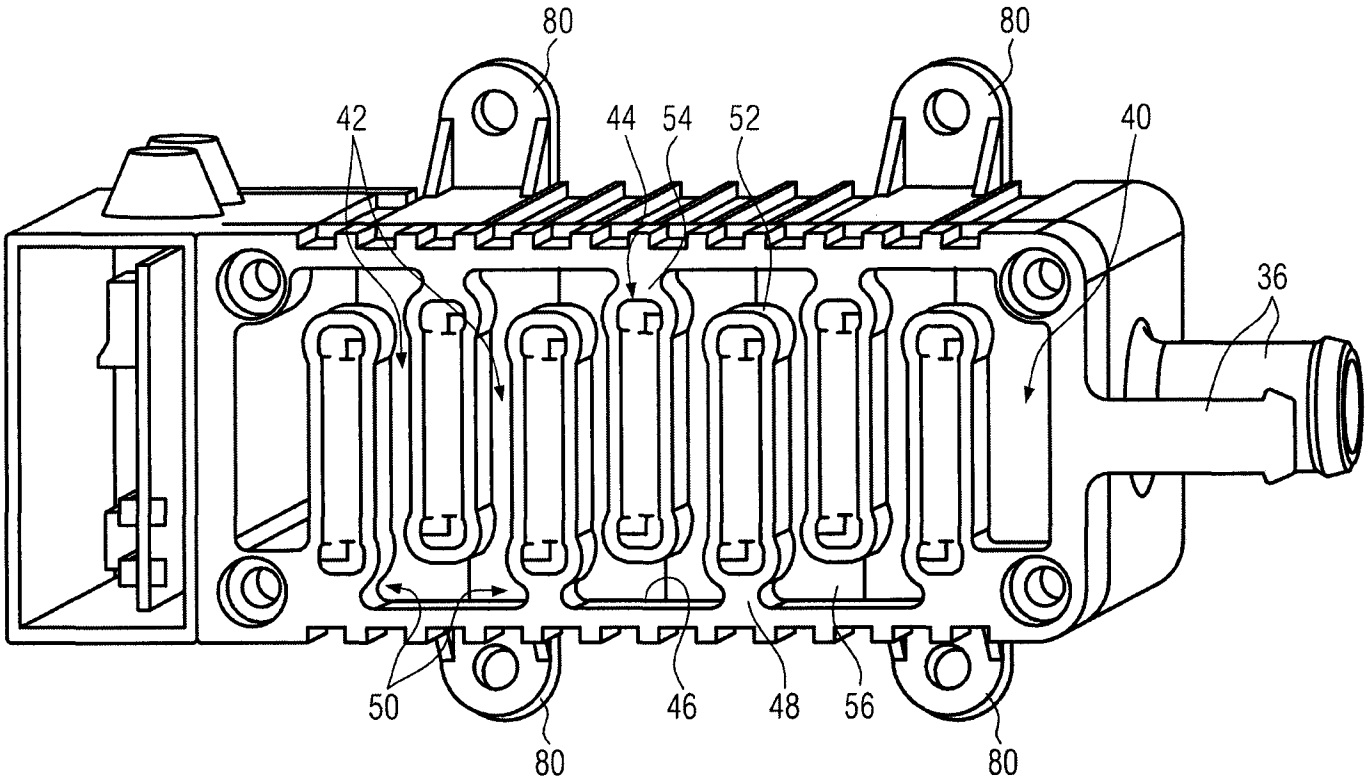
FIG. 3 a cross-sectional view along the line according to the illustration in FIG. 2.

The housings 2 illustrated in FIGS. 1 to 3 are identically formed so that a flow path through two meander-type flow channels 40 is produced between the two connection pieces 36. The previously described temperature probes 26 are also provided double and namely directly in the region of the opening of the connection pieces 36. For this purpose temperature probe holes 60 are formed in the relevant housings 2, 4 in each case for the accommodation of a temperature probe 26 (cf. FIG. 4).

Figure 4:
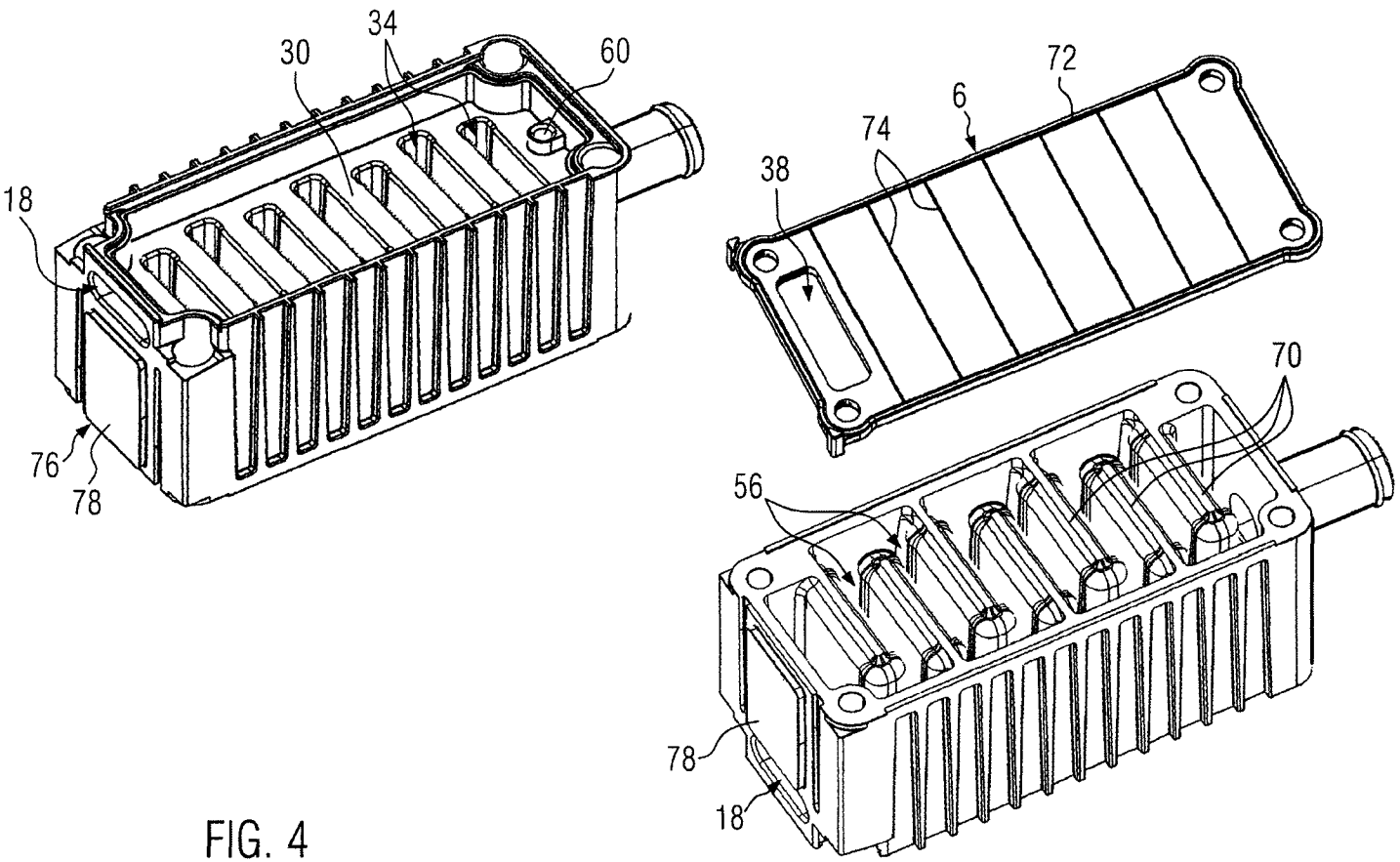
FIG. 4 perspective views of the two housings with the covering elements of the previously discussed embodiment provided in between them.

Furthermore, as can be seen from FIG. 4, tapered ridges 70 are formed on the underside of the heating ribs 44. All tapered ridges 70 terminate at the same height and form a support level for the covering element 6. Accordingly, the covering element between the tapered ridges 70 and the supporting counter ridges 71 of the oppositely situated housings 2, 4 is clamped for sealing.

The covering element 6 can for example be formed from a metal sheet, around which a flexible plastic is injection molded around, on one hand to form a circumferential sealing edge 72 and on the other hand however the sealing strips corresponding to the meander-type structure of the tapered ridges 70, which are illustrated in FIGS. 1 and 4, and which abut between the mutually oppositely situated, tapered ridges 70. The sealing edge 72 is clamped between the mutually oppositely situated face sides of the housings 2, 4.

On the face sides facing the control housing 10 the housings 2, 4 have a protrusion formed by milling, through which a cooling element 76 is formed in each case, which constitutes a cooling element contact base 78 extending parallel to the face side and the oppositely situated surface of which is exposed in the circulation chamber in the vicinity of the flow passage aperture 38 (cf. FIG. 4).

With the embodiment illustrated in FIGS. 1 to 4 the housing covers 8 are normally formed from punched metal. Also, they can bear a seal in an elastic plastic formed by injection molding around the housing covers 8. This applies correspondingly to the housing cover 16. Normally, the housing covers 8 in any case contact the housings 2, 4 through screws which also fix and seal the two housings 2, 4 together with the intermediate positioning of the covering element 6. The housings 2, 4 are formed identically. The feet 80 visible in FIGS. 1 and 3 can be separately manufactured and fastened retrospectively to the outer wall of the lower housing 2. The heating power of the electrical heating device can be increased in that a further package of two housings 2, 4 is positioned adjacent to that shown in FIGS. 1 to 4. The control of the individual heater plate elements 24 can be realised by a uniform controller with a uniform control housing.

Figure 5:
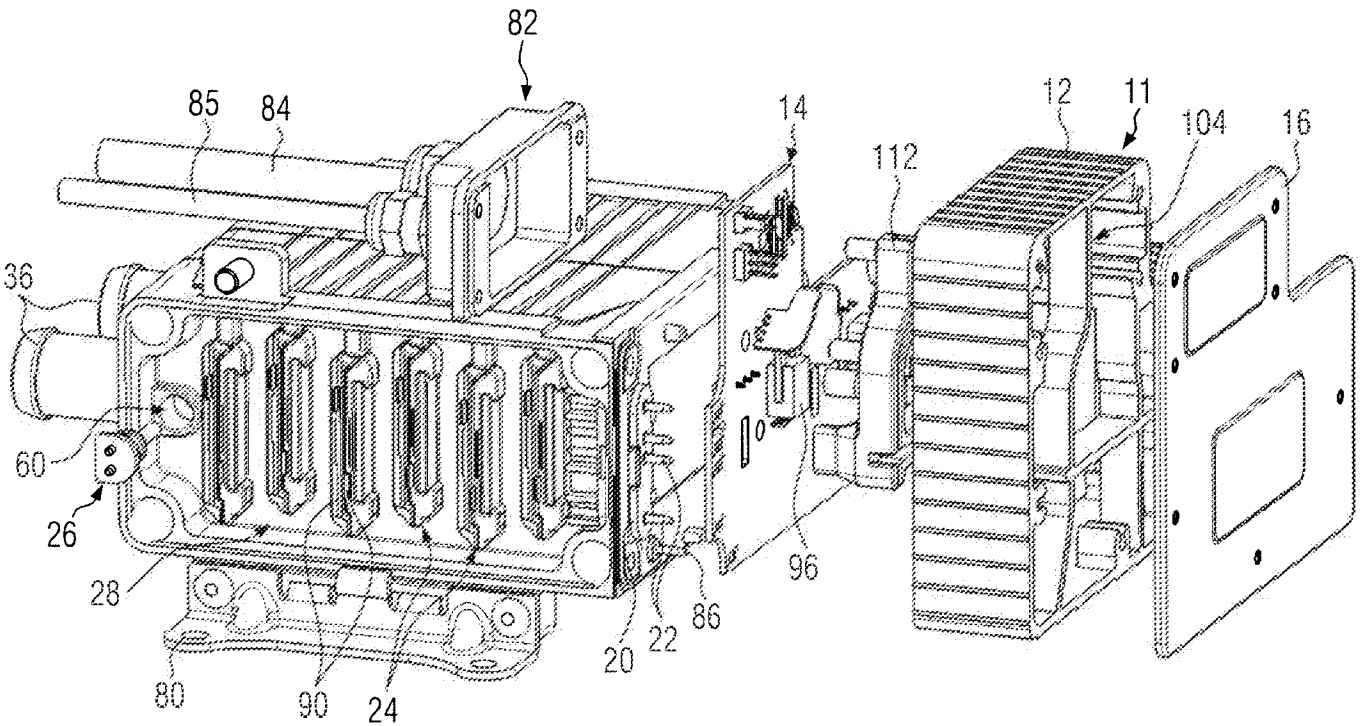
FIG. 5 an exploded drawing of a second embodiment.

FIGS. 5 to 11 illustrate a further embodiment of a heating device according to the invention. The same components are identified with the same reference numerals compared to the previously discussed embodiment. The construction of the housings 2, 4 of the circulation chambers 32 and the connecting chambers 28 is essentially identical to the previously discussed embodiment. However, the control housing 10 of the control device 11 extends sideward over the two housings 2, 4 for mounting a connecting housing 82, which bears an electrical cable 84 for the power current and an electrical cable 85 for the control signals and leads in a sealed manner into the interior of the connecting housing 82. In the region of the connection pieces 36 a contact element 86, contacting the housings 2, 4 electrically, is provided in each case, which facilitates a check of the polarity of the two housings 2, 4 in order to detect any fault in the electrical isolation of the housing 2 or 4 from the current-carrying paths. FIG. 5 illustrates in any case the connecting end of this further contact element 86.

Figure 6:
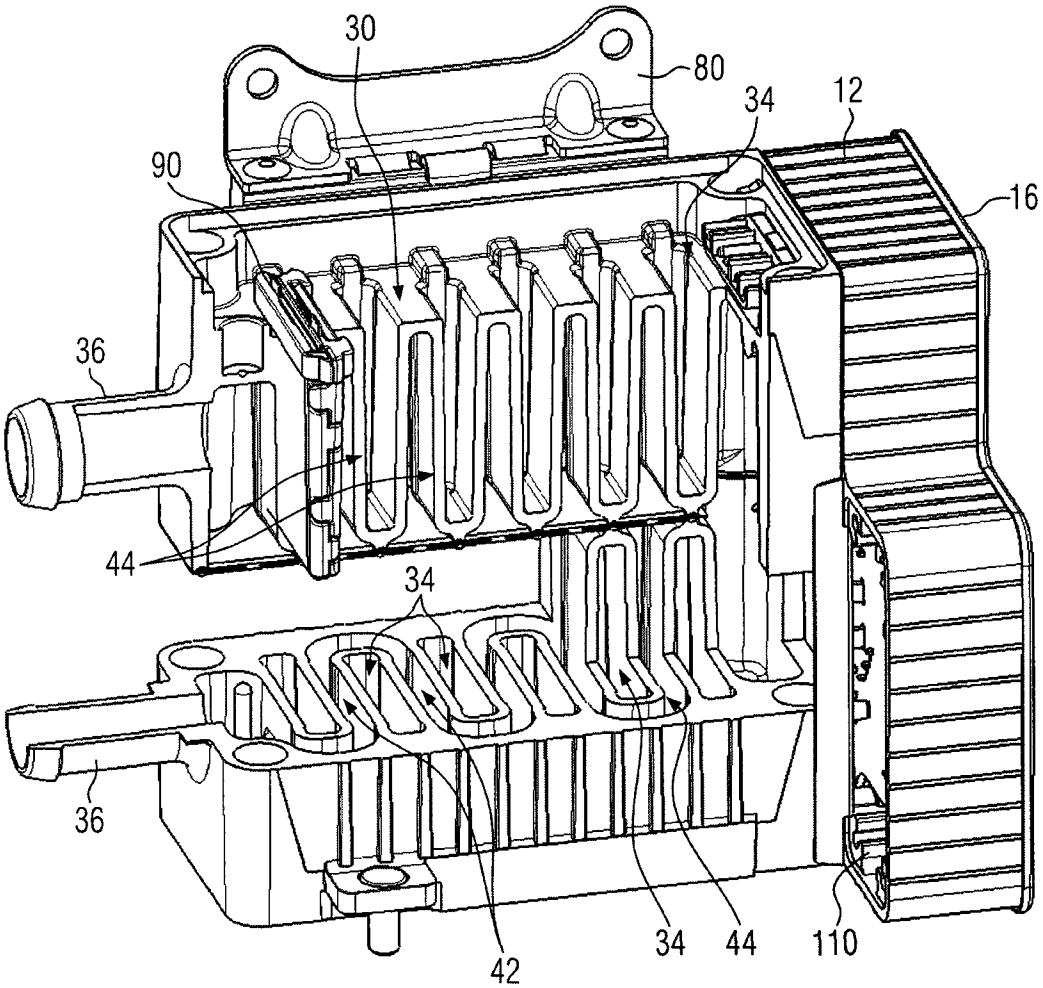
FIG. 6 a partially cut-away perspective side view of the second embodiment.

The parts of the embodiment omitted in FIG. 6 clearly show the flow path within the housings 2, 4 as well as the embodiment of the heating ribs 44 and of the U-shaped recesses 34 formed in them.

As can also be seen from FIG. 6, the heater plate elements 24 have a widened collar 88, which rests on the upper side of the partition wall 30, so that the heater plate elements 24 protrude into the U-shaped recesses 34 with a certain depth. This collar 88 has contact lugs 90 of the heater plate elements 24 protruding over it. These contact lugs 90 are freely cut ends of electrically conducting sheet metal plates, which contact PTC blocks 92 on both sides, can supply current to them with different polarity and are graphically illustrated in FIG. 7 and are identified with the reference numeral 93. Four PTC blocks 92 are enveloped one above the other by each heater plate element 24. As can also be taken from FIG. 7, the contact lugs 90 are exposed at the same level within the connecting chamber 28. At this level the connecting end of the temperature probe 26 is exposed.

Figure 7:
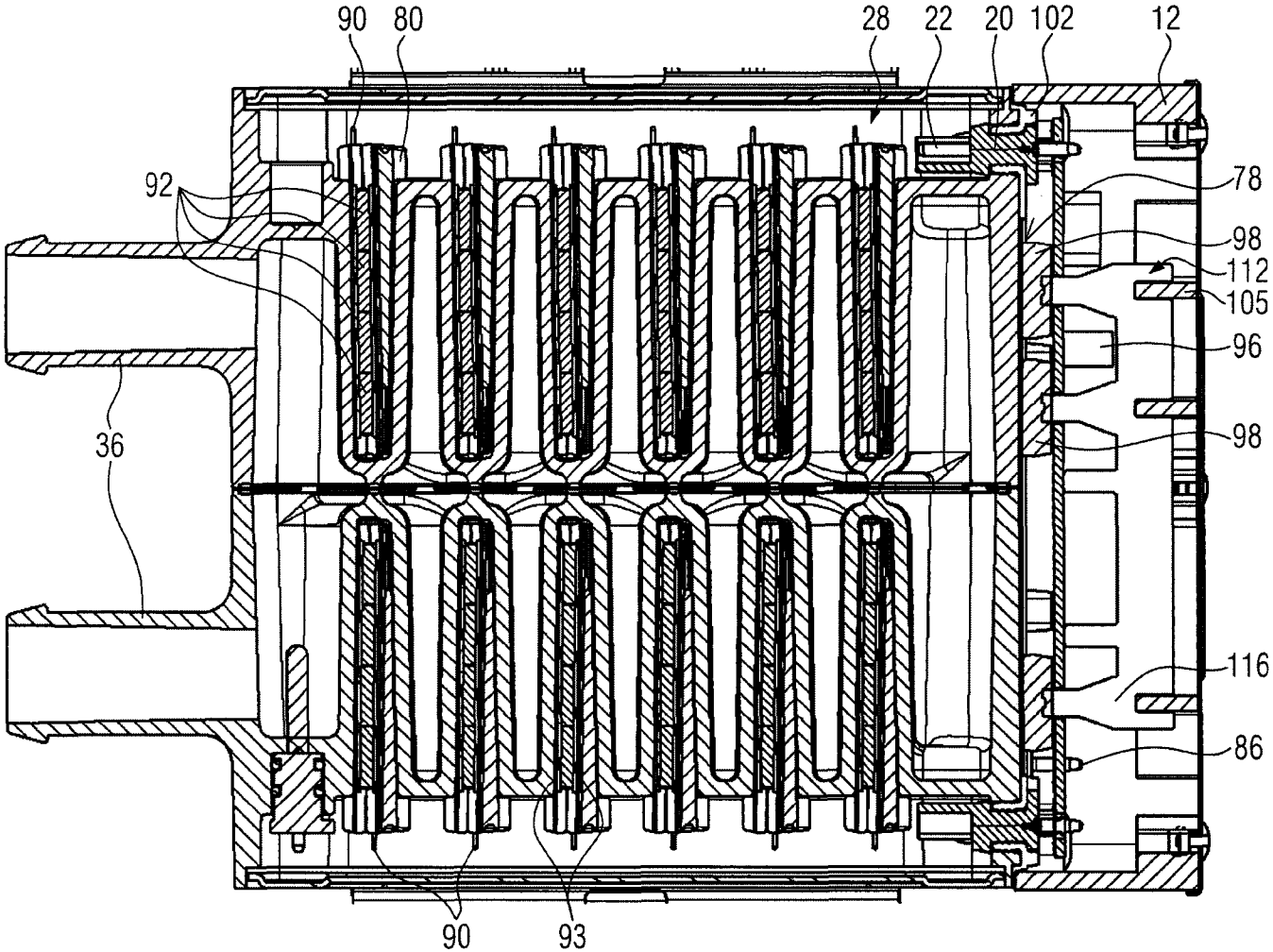
FIG. 7 a longitudinal sectional view of the second embodiment.
Figure 8:
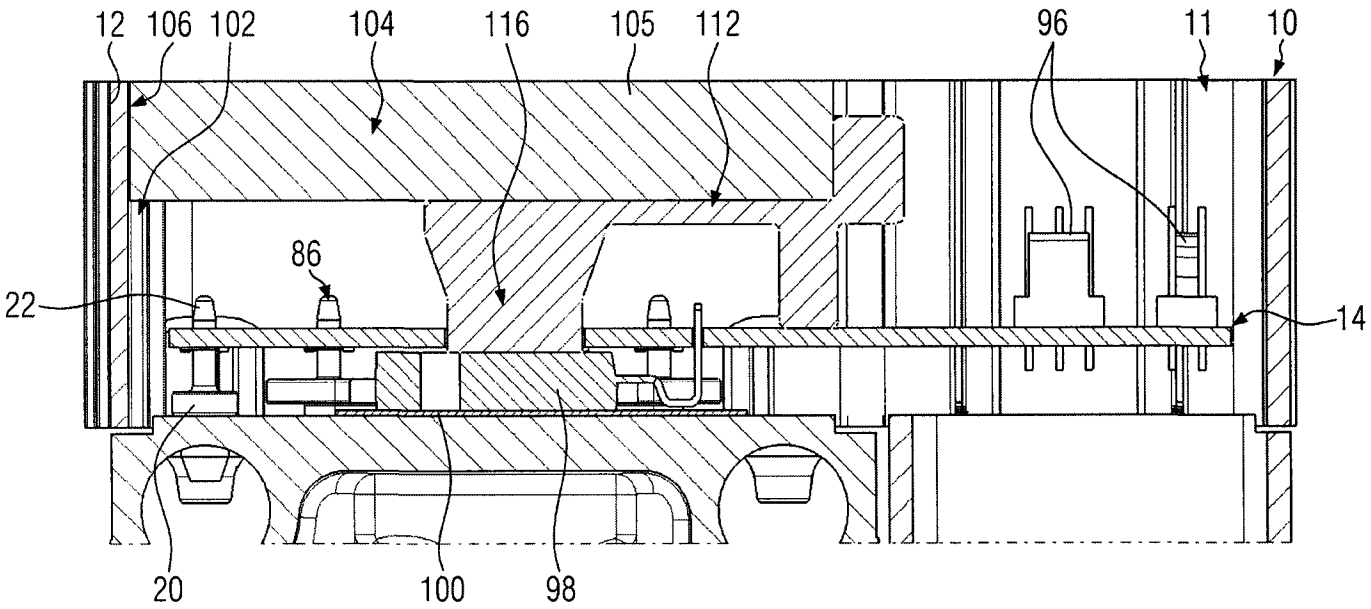
FIG. 8 an enlarged longitudinal sectional view of the control housing of the second embodiment.

In the connecting chamber 28 there is a connecting conductor board, the representation of which is omitted in FIG. 7, but which is identified with the reference numeral 94 in FIG. 2. The connecting conductor board 94 extends essentially parallel to the partition wall 30 and rests on the collar 88. It forms electrical connecting elements for the accommodation of the individual contact lugs 90 and a contact receptacle for the connecting end of the temperature probe 26. On the face side oppositely situated to the temperature probe 26 the connecting conductor board 94 has electrical connecting recesses for contacting the plug elements 22 exposed in the connecting chamber 28. The connecting conductor board 94 and the electrical connecting elements of it are here embodied such that all electrical connections to the connecting conductor board 94 are realised when the connecting conductor board 94 is placed on the collars 88. Thus the electrical plug contacts in the connecting chamber 28 are electrically connected to the plug elements 22.

In the following the construction of the control device 11 is described, particularly with reference to the FIGS. 7 to 11. On its surface facing away from the housings 2, 4 the assembled conductor board 14 bears various electrical or electronic components 96. On the oppositely situated underside of the assembled conductor board 14, facing the housings 2, 4, components and control elements 98 producing a power loss, in particular power transistors, are provided. Between these power transistors 98 and the cooling element contact base 78 there is an electrical insulating layer 100. This insulating layer 100 is located in a recess of a control housing base 102 of a flexible material, in particular in a flexible plastic, which is clamped between the face side of the control housing frame 12 facing the housing 2 or 4 and the face side of the housing 2, 4. This control housing base 102 has receptacles into which the plug housings 20 are introduced. The plug housings 20 have flanges which grasp the control housing base 102 on the uppersides and undersides (cf. FIGS. 7, 9). The control housing base 102 protrudes sleeve-like into the control housing connection openings 18, whereby secure mounting and sealing of the plug housings 20 is realised (cf. FIG. 7). The inside of the control housing 10 is accordingly sealed with respect to the connecting chamber 28.

Figure 9:
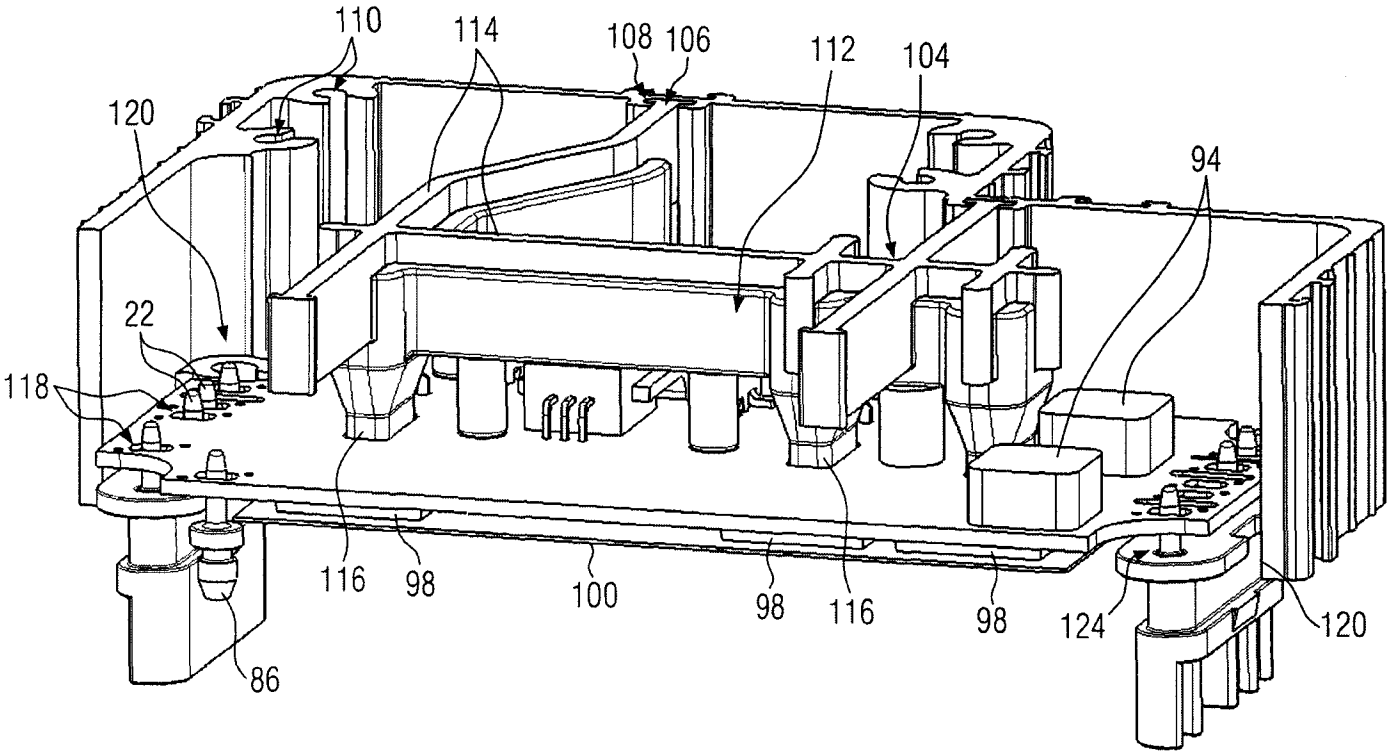
FIG. 9 a partially cut-away perspective side view of the control housing of the second embodiment.
Figure 10:
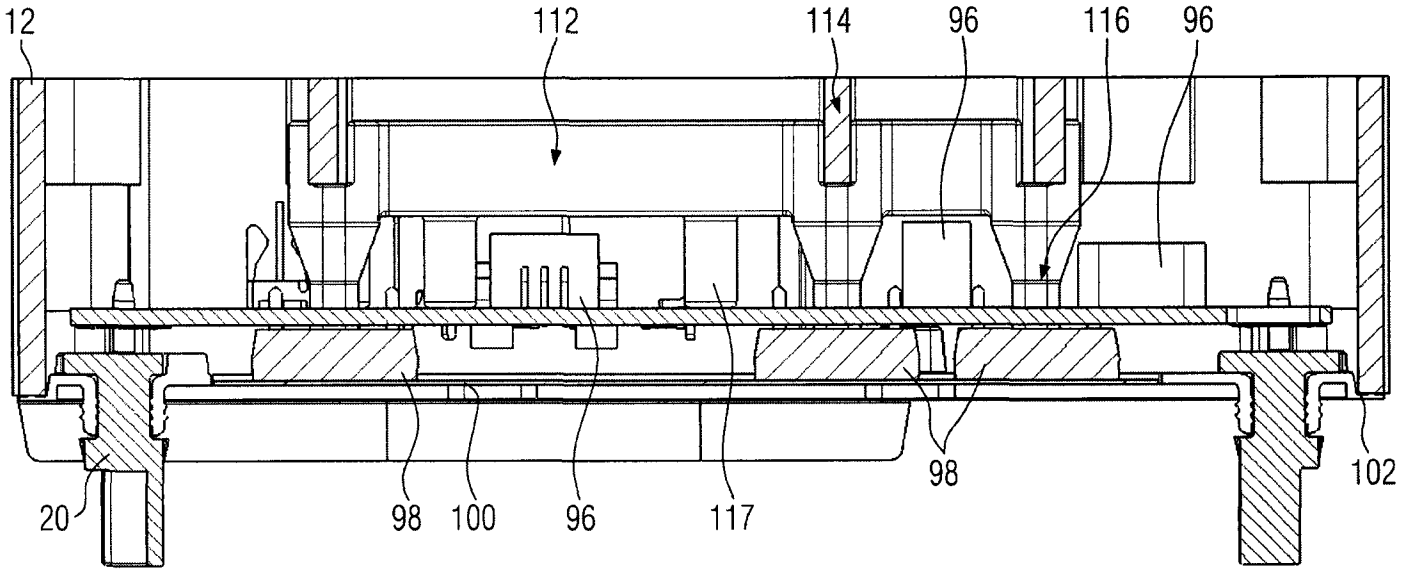
FIG. 10 a longitudinal sectional view of the control housing of the second embodiment.
Figure 11:
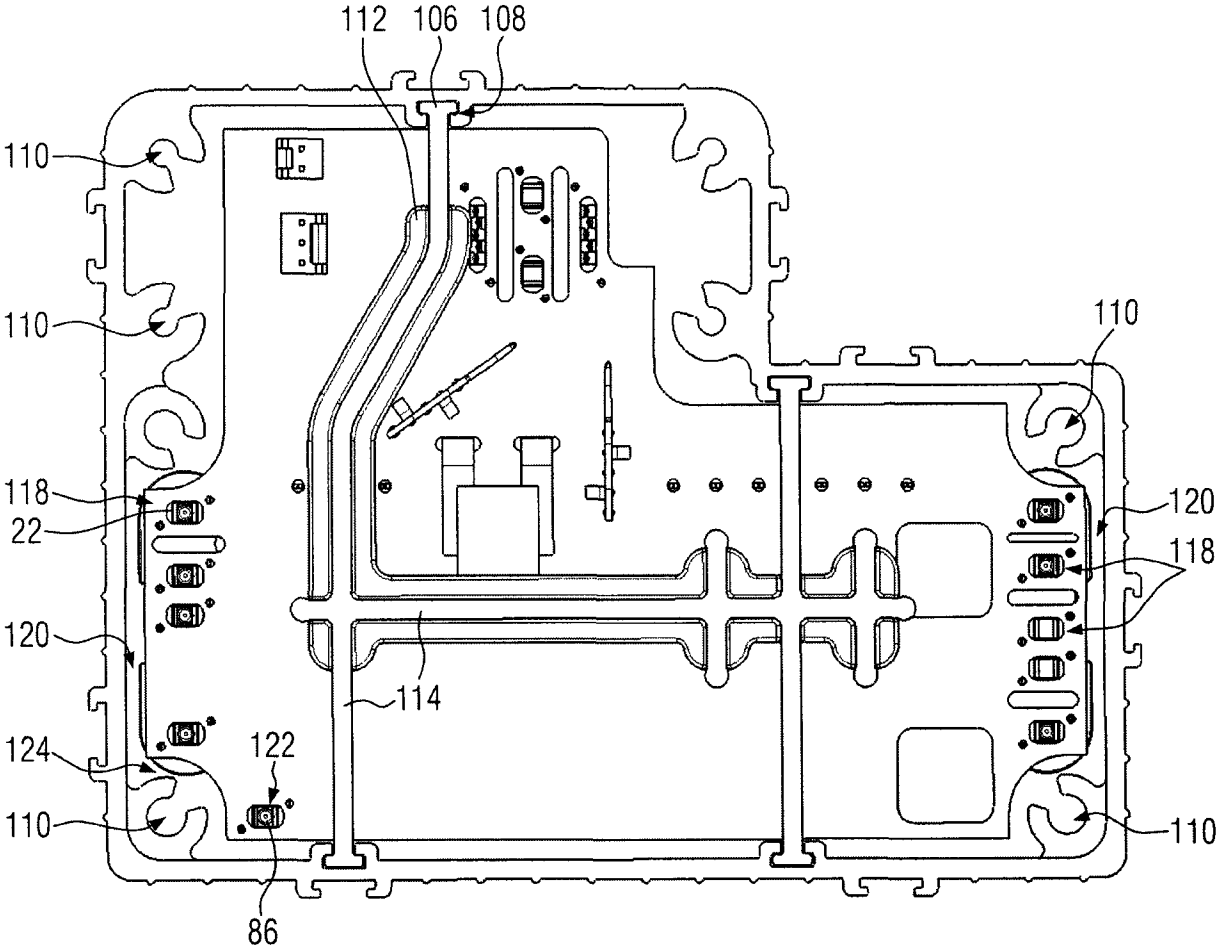
FIG. 11 a plan view of the control housing of the second embodiment.

As can be seen, particularly from FIGS. 9 and 11 a supporting framework structure 104, which is manufactured as a separate component, formed from thin ridges 105 forming the supporting framework structure 104, is located within the control housing frame 12. The ends of the ridges 105 are enlarged to a hammer head 106 in the vicinity of the control housing frame 12. The hammer head 106 is held in accommodating slots 108, which are formed on the inner wall of the control housing frame 12 by the control housing frame.

Also in the corner regions mounting protrusions in the form of mounting eyes 110, the longitudinal extension of which corresponds to the height of the control housing frame 12, are formed on the control housing frame 12. These eyes are not circumferentially closed, but rather have an open slit towards the inside of the control housing frame 12. The mounting eyes 110 are used for holding the threaded rods which join the control housing frame 12 to the housings 2, 4 with the inclusion of the control housing cover 16. They are also used however to accommodate threaded rods, which fasten the connecting housing 82 to the control housing frame 12.

Between the supporting framework structure 104 and the assembled conductor board 14 a compression element identified with the reference numeral 112 is provided in a flexible plastic. On its face side facing the supporting framework structure 104 this compression element 112 forms U-shaped recesses for the ridges 105 of the supporting framework structure 104, so that the compression element 112 is held positively locked on the supporting framework structure 104. The compression element 112 is similarly formed lattice-like, whereby lattice ridges 114 of the compression element 112 have pillar supports 116 of the compression element 112 extending over them, the said supports engaging corresponding recesses formed on the assembled circuit board 14 for this purpose and directly contacting the control components 98 producing the power loss. The pillar supports 116 are provided there where the control components 98 producing the power loss are arranged on the side of the assembled conductor board 14 oppositely situated with respect to the pillar supports 116. One or a plurality of retaining clamps 117, which act on the conductor board 14, protrude from the compression element 112 and/or the lattice ridges 114.

As can be seen from FIG. 11, the assembled conductor board 14 also has contact element receptacles 118, which are formed on oppositely situated marginal regions 120 of the assembled conductor board 14. The contact element receptacles 118 are formed as elongated holes. Also a further contact lug receptacle 122 for the contact element 86 is formed as an elongated hole. All elongated holes have longitudinal axes which are mutually parallel. Plug counter elements 119 are arranged in the contact element receptacles 118. The assembled conductor board 14 is fixed with a slight play within the control housing frame 12. In the corner regions of the assembled conductor board 14 cut-outs 124 are provided, whereby the mounting eyes 110 pass right through the plane of the assembled conductor board 14.

For assembly normally the control device 11 is first pre-assembled, i.e. the assembled conductor board 14 is arranged within the control housing frame 12. The plug housings 20 are inserted through the cut-outs in the control housing base 102 and thus connected. Then the pre-assembled control device 10 is pushed onto the housings 2, 4 with the intermediate positioning of the insulating layer 100. Here, the plug housings 20 are introduced for sealing into the housing connection openings 18. Due to the embodiment of the contact receptacles 118 as elongated holes, the plug elements 22 can in this respect perform a certain compensating movement without the electrical contact between these plug elements 22 and the plug counter elements 119 of the assembled conductor board 14 being lost. Then the control housing frame 12 together with the control housing cover 16 is screwed to the housings 2, 4. Here, first the surfaces of the control components 98 producing the power loss rest on the cooling element contact bases 78. After the assembly of the control housing 10 on the housings 2, 4 the control components 98 producing the power loss abut the cooling elements 76 at the housing end under prestress and are thus connected reliably for thermal conduction. Within the scope of this assembly the pillar supports 116 of the compression elements 112 are in particular elastically compressed, whereby an elastic prestress is stored in the compression element 112.

Figure 12:
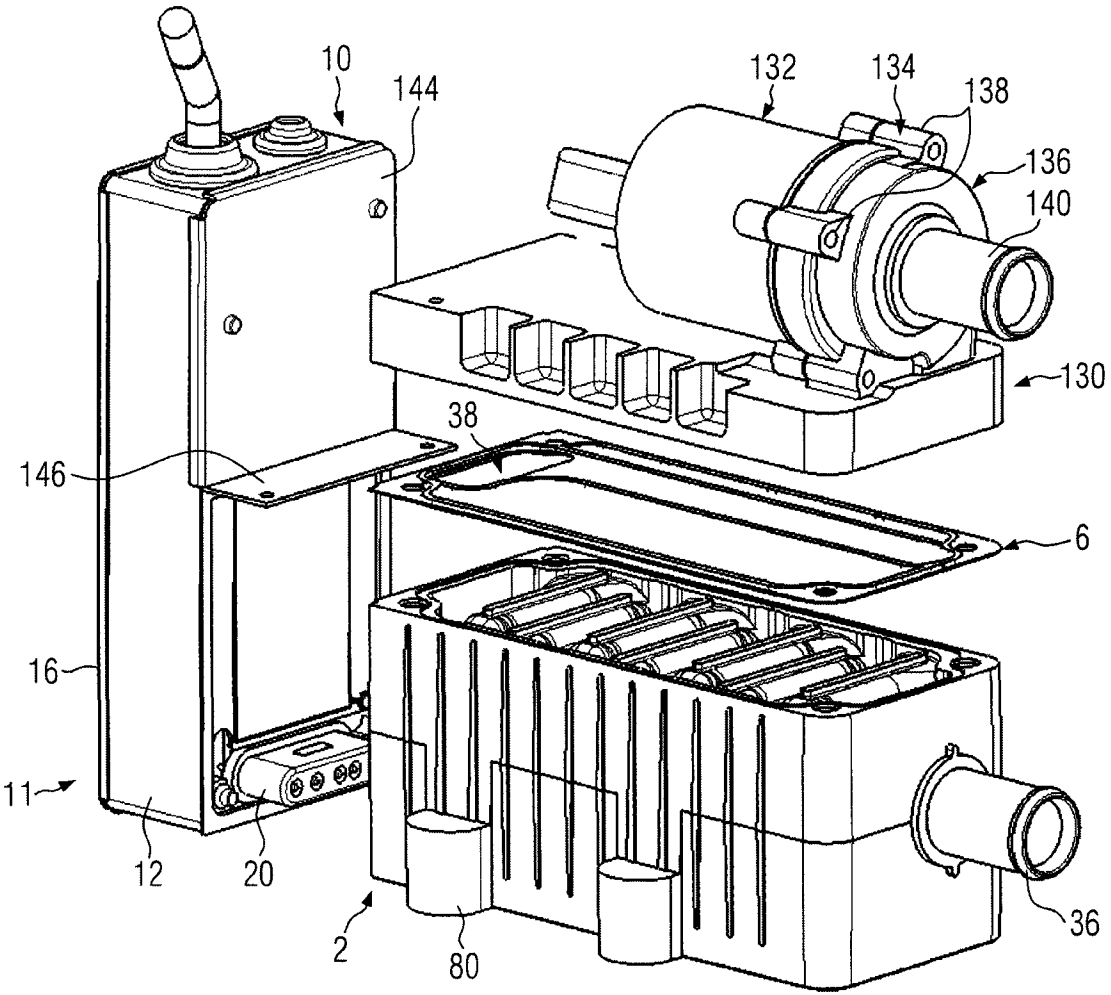
FIG. 12 an exploded drawing of a third embodiment.
Figure 13:
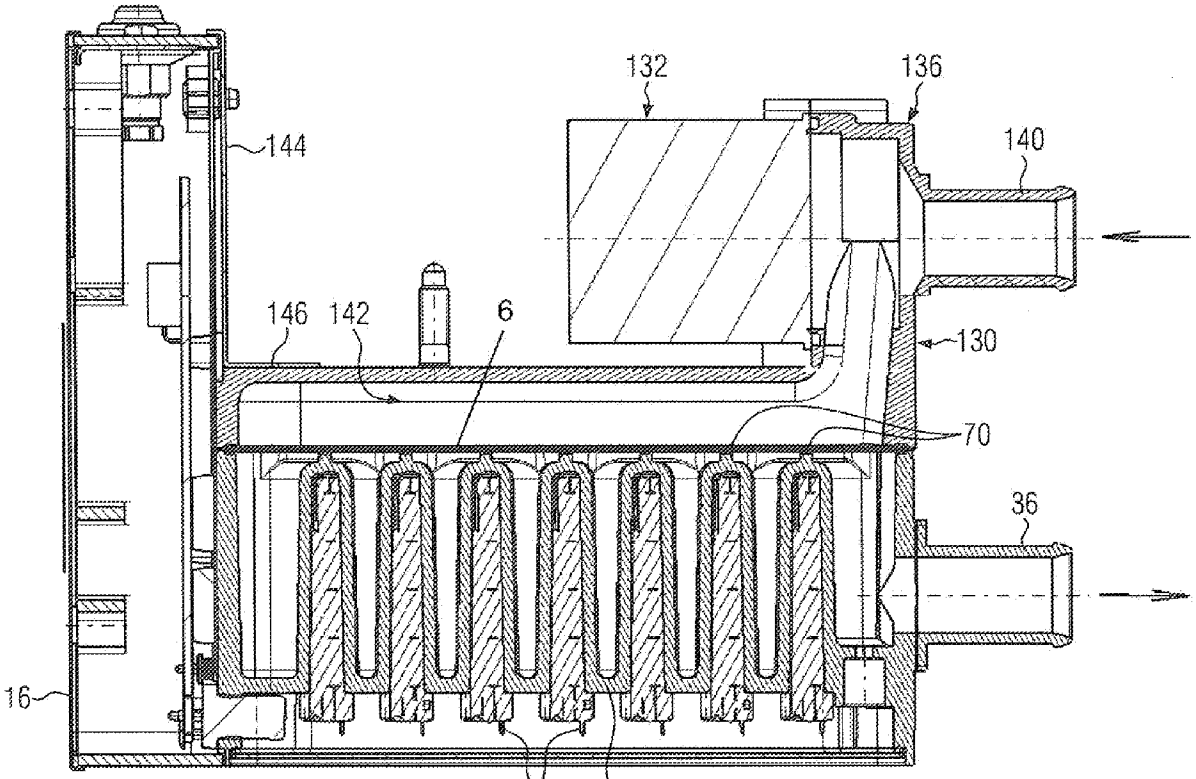
FIG. 13 a longitudinal sectional view of the third embodiment.

FIGS. 12 and 13 illustrate a further embodiment of an electrical heating device according to the invention. The same components are identified with the same reference numerals compared to the previously discussed embodiment.

The embodiment according to FIGS. 12 and 13 has only one housing 2, which is provided with a covering element 6 for forming the circulation chamber 32 between the covering element 6 and the partition wall 30. The embodiment also has a housing cover 130 which bears a pump 132 and in any case partially forms a pump housing 134. Here, the housing cover 130 forms a flow inlet housing part 136 which forms attachment elements 138 for flange-connecting the pump 132 and a hose connection piece 140. The covering element 6 only has sealing strips 74 suitable to the structure of the tapered ridges 70 on its underside facing the housing 2. On the oppositely situated upper side, sealing strips 74 are provided running on the covering element 6 suitable for a pump channel 142 formed by the housing cover 130. This pump channel 142 connects the flow passage aperture 38 to the flow inlet housing part 136.

The control housing frame 12 is formed identically to the embodiment discussed with reference to FIGS. 1 to 4. However the control housing frame is partially closed by a control housing base cover 144 which forms a bent flange 146 which is screwed onto the upper side of the control housing cover 130.

The power supply and the control connection of the pump 132 preferably occurs similarly via the assembled conductor board 12. With the embodiment illustrated in FIGS. 12 and 13 this occurs via a cable which connects the control device 11 to the pump 132. With the embodiment illustrated in FIGS. 12 and 13 the cable (not illustrated) extends from a lateral face of the control housing frame 12 to the pump 32. Just as well however, a plug housing 20 can be provided at the level of the pump 132 through which the electrical connection of the pump 132 occurs.

Figure 14:
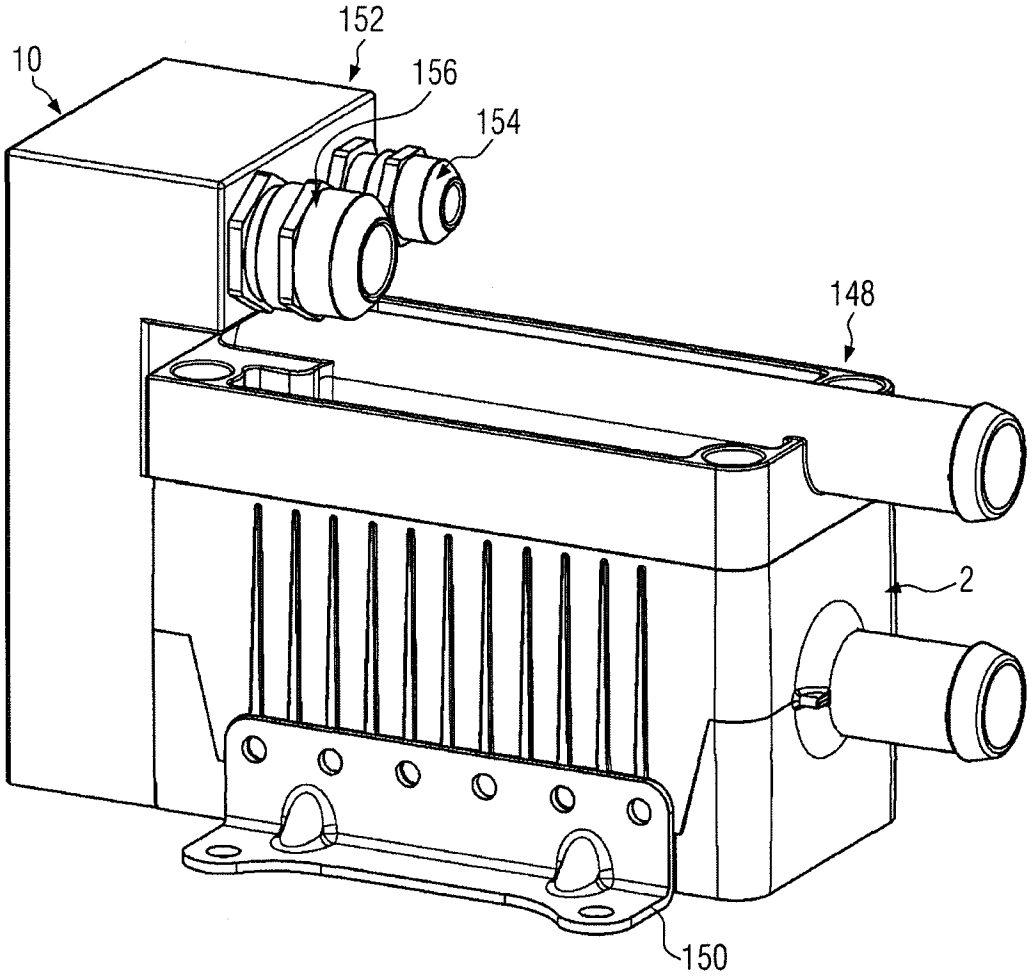
FIG. 14 a perspective side view of a fourth embodiment.
Figure 15:
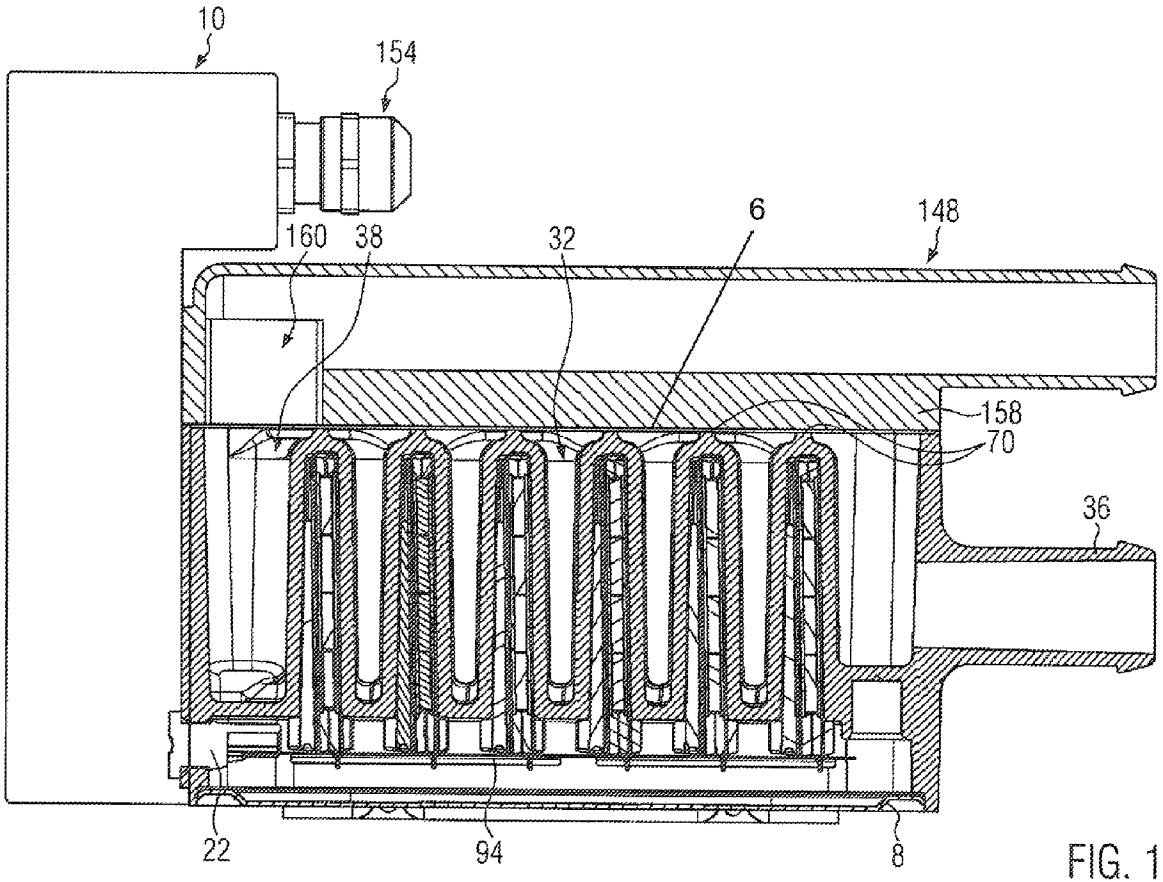
FIG. 15 a longitudinal sectional view of the fourth embodiment illustrated in FIG. 14.

FIGS. 14 and 15 illustrate a fourth embodiment. The same components are identified with the same reference numerals compared to the previously discussed embodiment.

As the previously described embodiments, the fourth embodiment comprises a housing 2 which is joined to a housing cover 148 and mounting flanges 150 for mounting the electrical heating device are fitted to its longitudinal sides. On a face side of the housing 2 and the housing cover 148 there is the control housing 10 with the controller which is accommodated in it and which is not detailed in FIGS. 14 and 15. This control housing 10 is in the present case formed L-shaped with an overhang 152 protruding slightly over the housing cover 148, with two cable clamps 154, 156 mounted on its face sides for mounting and sealing cables secure against twisting and strain. The cable clamp 154 is used for connecting a connecting cable; the larger cable clamp 156 is used for connecting a cable for the power current. The housing 2 is formed identically to the previously described housings 2. In this respect reference is made to the above description.

The housing cover 148 has a bottom plate 158 positioned on the housing 2, with the said bottom plate interacting with the edge of the housing 2 and the tapered ridge 70 with the inclusion of the covering element 6, whereby the circulation chamber 32 is sealed in the region of the tapered ridges 70. In the flow direction behind the flow passage aperture 38, the housing cover 148 forms a flow passage 160 which communicates with a tube 162 formed as one part on the housing cover 148, which extends parallel to the connection piece 136 and terminates with it essentially at the same level.

The embodiment illustrated in FIGS. 14 and 15 is relatively small and has a thermal output of not more than 3 kW, and normally a thermal output of between 1.5 and 2.8 kW. The embodiment is suitable for example for battery preheating in electric vehicles.

What is claimed is:

1. An electrical heating device for a motor-vehicle, comprising: a housing which encloses a circulation chamber through which a medium can flow, and into which heating ribs protrude, each of the heating ribs having a U-shaped recess which open into a uniform connecting chamber which is separated from the circulation chamber by a partition wall provided in a region of open ends of the U-shaped recesses, wherein the housing accommodates at least one PTC heating element which abuts oppositely situated inner sides of the U-shaped recess in heat-conducting contact, and further comprising a pump and a housing cover which bears the pump, wherein a pump channel is formed by a hollow space within an interior of the housing cover, the hollow space running along a length of the housing cover, the pump channel opening into an inlet opening of the pump, the inlet opening of the pump being formed by a pump housing.

2. An electrical heating device according to claim 1 wherein a covering element is clamped between the housing and the housing cover, wherein the covering element separates a flow channel, formed between the partition wall and the covering element in the circulation chamber, from the pump channel, and wherein the covering element has a flow passage aperture formed therein, through which the flow channel communicates with the pump channel.

3. An electrical heating device according to claim 1, wherein, on an underside of the heating ribs, tapered supporting ridges form a support level for a covering element.

4. An electrical heating device according to claim 1, wherein the heating ribs protrude inwards alternately from oppositely situated inner sides of the housing such that a flow channel in the housing is formed in a meandering manner and comprises flow passages between free ends of the heating ribs and an adjacent inner wall of the housing.

5. An electrical heating device according to claim 1, wherein the heating ribs are connected through a ridge to an assigned inner wall of the housing, and wherein the ridge is less thick than the heating ribs.

6. An electrical heating device according to claim 5, wherein lateral faces of the ridge that are exposed to a flow channel are formed concave, so that a hollow-shaped recess is formed between an inner wall and a heating rib.

7. An electrical heating device according to claim 1, further comprising:

a connecting conductor board, extending parallel to the partition wall and held in the connecting chamber with conductive paths and with electrical connecting elements which make contact with contact lugs of the PTC heating elements protruding over the partition wall; and an assembled conductor board which extends at right angles to the connecting conductor board in front of a face side of the housing.

8. An electrical heating device according to claim 7, wherein, on the face side of the housing, the housing has a housing connection opening which opens to the connecting chamber and in which a plug housing is inserted, wherein electrical plug elements of the plug housing are connected to plug counter elements provided on the connecting conductor board or on the assembled conductor board.

9. An electrical heating device according to claim 7, wherein the assembled conductor board is provided with spacing to the face side of the housing and bears at least one component which produces a power loss, and wherein, between the face side of the housing and the assembled conductor board, a cooling element thermally couples the at least one component which produces a power loss to the face side of the housing.

10. An electrical heating device according to claim 7, wherein the assembled conductor board also bears components of a control device for the pump.

11. An electrical heating device according to claim 2, wherein the housing, on a face side, bears a connection piece, which communicates with the flow channel, and wherein the flow channel aperture is situated at the opposite end of the connection piece.

12. An electrical heating device according to claim 11, wherein the pump housing and the housing each bear a connection piece.

13. An electrical heating device according to claim 1, wherein the housing cover and at least parts of the pump housing are formed from one block.

14. An electrical heating device according to claim 8, further comprising a control housing which encloses the assembled conductor board and which forms a control housing connection opening corresponding to the housing connection opening, wherein a further control housing connection opening, which in relation to a level accommodating a covering element, is formed mirrored on the control housing in relation to the level accommodating the covering element.

15. An electrical heating device for a motor-vehicle comprising:

a housing which encloses a circulation chamber through which a medium can flow;

heating ribs that protrude into the circulation chamber, each of the heating ribs having a U-shaped recess which open into a uniform connecting chamber which is separated from the circulation chamber by a partition wall provided in the region of open ends of the U-shaped recesses;

at least one PTC heating element which is held in the housing and which abuts oppositely situated inner sides of the U-shaped recess in heat-conducting contact therewith;

a pump; and a housing cover which bears the pump, wherein a pump channel is formed by a hollow space within an interior of the housing cover, the hollow space running along a length of the housing cover, the pump channel opening into an inlet opening of the pump, the inlet opening of the pump being formed by a pump housing.

* * * * *